United States Patent [19]

Hoshino et al.

[11] Patent Number: 4,967,516

[45] Date of Patent: Nov. 6, 1990

[54] DEBRIS COLLECTION SYSTEM FOR A SURFACE TREATING TOOL

[75] Inventors: Kiyoshi Hoshino, Clemson; James A. Keith, Jr., Pickens, both of S.C.

[73] Assignee: Ryobi Motor Products Corp., Pickens, S.C.

[21] Appl. No.: 450,273

[22] Filed: Dec. 13, 1989

[51] Int. Cl.[5] ..... B24B 23/00; B24B 55/06

[52] U.S. Cl. ..... 51/170 R; 51/273; D8/62

[58] Field of Search ..... 51/170 R, 170 TL, 170 T, 51/107 MT, 273, 270, 174, 177; 409/137; D8/62, 90

[56] References Cited

U.S. PATENT DOCUMENTS 4,317,314 3/1982 Carlstrom ..... 51/177
4,549,371 10/1985 Hakoda ..... 51/170 MT
4,729,195 3/1988 Berger ..... 51/170 MT
4,731,895 3/1988 Zack ..... 51/177

FOREIGN PATENT DOCUMENTS 3402062 8/1985 Fed. Rep. of Germany ..... 51/170 MT
79818 12/1962 France ..... 51/177

*Primary Examiner*—Roscoe V. Parker
*Attorney, Agent, or Firm*—David L. Davis

[57] ABSTRACT

A surface treating tool is provided with a debris collection container which includes a semi-rigid frame defining at least one window and mesh fabric covering that window. The exterior configuration of the container is such that the container blends in which the contour of the tool to provide an aesthetically pleasing appearance.

8 Claims, 4 Drawing Sheets

DEBRIS COLLECTION SYSTEM FOR A SURFACE TREATING TOOL

BACKGROUND OF THE INVENTION

This invention relates to an electrically powered portable surface treating tool such as a sander, and the like, which creates debris as a result of surface abrasion and, more particularly, to an improved system for collecting such debris for subsequent disposal thereof.

Electrically powered portable surface treating tools such as sanders, and the like, typically are provided with a platen which has a surface for supporting thereon a sheet of abrasive material, such as sandpaper. Such a tool has an electric motor, the output shaft of which is coupled to the platen through an actuating mechanism which converts the rotary motion of the output shaft into motion of the platen. This latter motion may be rotary, reciprocatory, orbital or some combination thereof, and results in relative motion between the abrasive sheet and the surface being treated. The resulting abrasion of the surface produces debris, such as sanding dust.

The debris created by the surface treating operation is unwanted and numerous arrangements have been devised in the past for removing such debris from the work area, and for collecting and depositing it in a receptacle for subsequent disposal thereof. Typically, these arrangements include a fan mounted on the output shaft of the motor for creating suction, along with the provision of passageways by which the suction induced airflow can remove the debris from the surface and transport it to a collection port. Generally, a debris collection filter bag is supported on the collection port and the debris laden air is directed into the bag which allows the air to pass therethrough while containing the debris therein.

While such an arrangement performs its intended function, it suffers from a number of disadvantages. For example, the debris collection filter bag is generally relatively large and flaccid so that it tends to obstruct a clear view of the surface work area and can also interfere with proper handling of the tool. Further, such a debris collection filter bag can prove to be difficult to empty and clean. In addition, when using such a debris collection filter bag, it is difficult to ascertain when the bag should be emptied. Also, such a debris collection filter bag detracts from the aesthetic appearance of the tool.

Accordingly, it is a general object of this invention to provide a debris collection system for a surface treating tool which overcomes the above-noted disadvantages of prior arrangements.

SUMMARY OF THE INVENTION

The foregoing, and additional, objects are attained in accordance with the principles of this invention by providing a surface treating tool of the type described wherein debris collection is effected through the use of a relatively rigid debris collection container having windows covered with a mesh fabric, which container is latched onto the exhaust port of a debris collection conduit. This container is easily removable from, and installed on, the tool and is further easily inverted for the dumping of its contents. Preferably, the container is formed of a plastic material which may be washed for cleaning purposes. Also, the exterior configuration of the container is so designed that it blends in with the contours of the tool to achieve a generally pleasing overall aesthetic appearance.

BRIEF DESCRIPTION OF THE DRAWINGS

The foregoing will be more readily apparent upon reading the following description in conjunction with the drawings wherein like elements in different figures have the same reference numeral and wherein.

DETAILED DESCRIPTION

Figure 1:
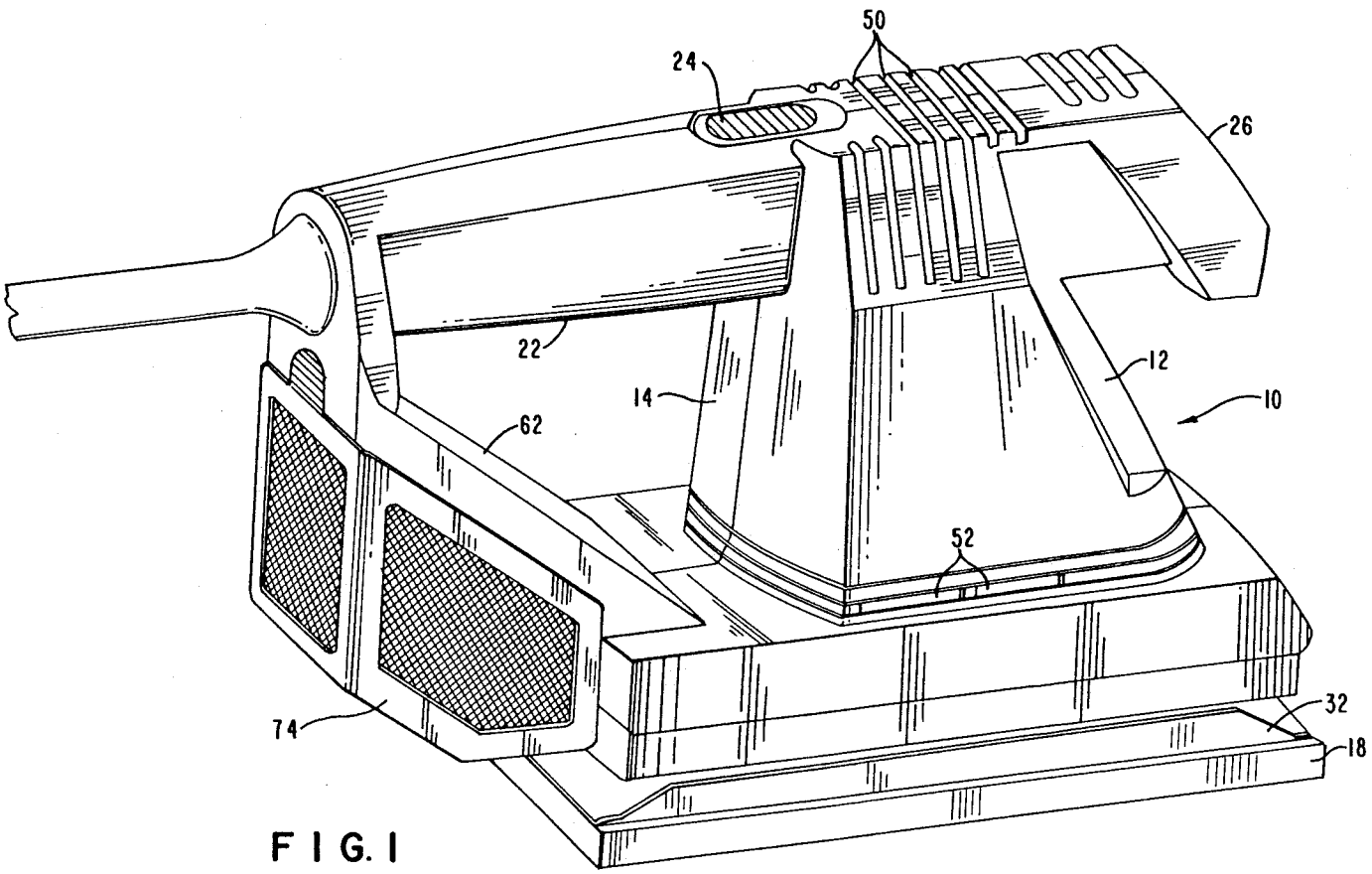
FIG. 1 is a perspective view showing an illustrative surface treating tool having a debris collection system constructed in accordance with the principles of this invention.

As shown in the drawings, this invention is illustrated in the environment of a pad sander, designated generally by the reference numeral 10. As is conventional, the sander 10 includes a clamshell housing 12 of plastic or like material comprising a pair of complementary halves which are detachably connected along a longitudinal split by screws or the like. The housing 12 includes a tower section 14 within which is supported a rotating electric motor !6 and below which is carried a platen 18 having a surface 20 for supporting an abrasive sheet, such as sandpaper, in a conventional manner. The housing 12 further includes a generally horizontal handle section 22 which extends rearwardly from the upper end of the tower section 14 beyond the rear extremity of the platen 18. The handle section 22 carries a switch actuator 24 which is coupled to control an electric switch through which power can be selectively applied from a suitable source of electric power to the motor 16, for operating the sander 10. A forwardly positioned auxiliary handle 26 may also be provided so that the sander 10 can be more effectively grasped and controlled by the operator.

Figure 4:
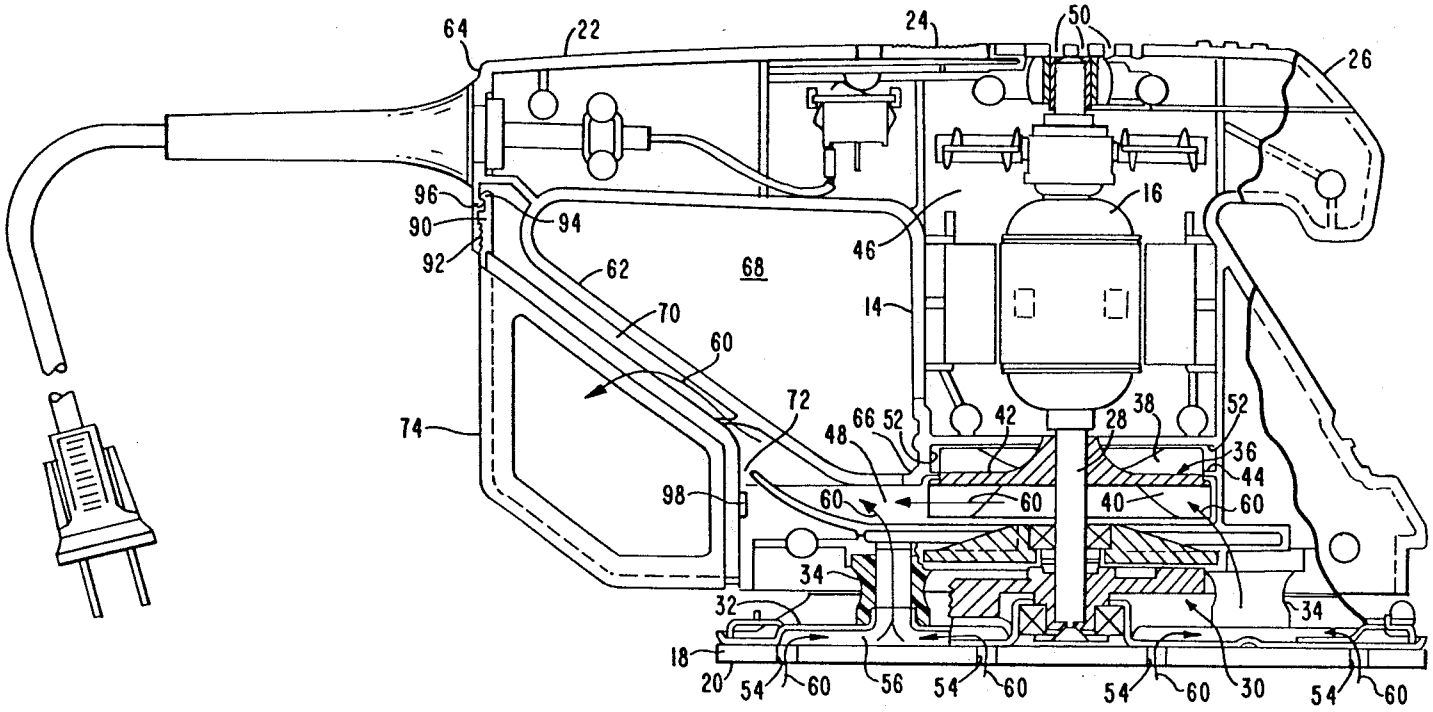
FIG. 4 is a side view, partially in cross section, of the tool shown in FIG. 1.

As shown in FIG. 4, the motor 16 includes an output shaft 28. An actuating mechanism 30 couples the output shaft 28 to the platen 18 for converting rotary motion of the output shaft 28 to motion of the platen 18. The motion of the platen !8 may be reciprocatory, orbital, or some combination thereof. As is conventional, the platen 18 includes a backing plate 32 which is carried by the housing 12 by means of a plurality of resilient rubber posts 34. The resilient rubber posts 34 secure the platen 18 to the housing 12 while allowing relative motion therebetween due to the actuating mechanism 30.

Located within the tower section 14, between the motor 16 and the actuating mechanism 30, is a centrifugal fan 36 mounted on, and for rotation with, the output shaft 28. The fan 36 has two sets of blades or vanes, an upper set 38 and a lower set 40, separated by a circular flange 42. The tower section 14, in radial alignment with the flange 42, is provided with an inwardly directed generally complementary flange portion 44, which defines in the tower section 14 two fan housing chambers, an upper chamber 46 associated with the upper vane set 38 and a lower chamber 48 associated with the lower vane set 40. Accordingly, the fan 36 serves to provide simultaneous air flow through two separate channels or flow paths in the tower section 14 separated by the complementary flanges 42 and 44. In one channel or flow path, which may be referred to as the cooling air flow path, air is drawn by means of the upper set of fan vanes 38 through inlet openings 50 provided in the tower section 14 above the motor 16 for flow past the motor 16 and exhaust flow outwardly of the tower section 14 through air exhaust openings 52 communicating with the upper fan chamber 46.

The platen 18 illustratively is formed with a plurality of openings 54. The openings 54 communicate with chambers 56 formed by the shaping of the backing plate 32. Each of the posts 34 is hollow and the backing plate 32 is so formed with stubs 58 which are press fit into the central opening of the posts 34 so that the interiors of the posts 34 communicate with respective chambers 56 and in turn with respective platen openings 54. The upper ends of the interior openings of the posts 34 communicate directly with the lower fan chamber 48. Accordingly, the lower fan vane set 40 induces suction relative the openings 54 to cause air flow through the platen 18 and into the lower chamber 48, as indicated by the arrows 60. The abrasive sheet (i.e., the sandpaper), fastened onto the lower surface 20 of the platen 18 is pierced at locations corresponding to the openings 54 in the platen 18. Therefore, the suction induced by the lower fan vane set 40 causes debris created by the abrasive action of the sander 10 to be drawn upwardly through the openings 54 and into the lower chamber 48.

In accordance with this invention, the housing 12 is further formed with a conduit section 62 which extends from the distal end 64 of the handle section 22 to the lower end 66 of the tower section 14. The conduit section 62 is spaced from the handle section 66 so as to provide an open handhold region 68 below the handle section 22. The conduit section 62 is hollow so as to form a conduit 70 therethrough, which conduit 70 is open at its lower end to the lower fan chamber 48. The conduit section 62 is further formed with an exhaust port 72 on its lower surface. Thus, debris laden air which is pulled through the platen openings 54 travels through the lower fan chamber 48 and into the conduit 70, from whence it is discharged through the exhaust port 72.

Figure 2:
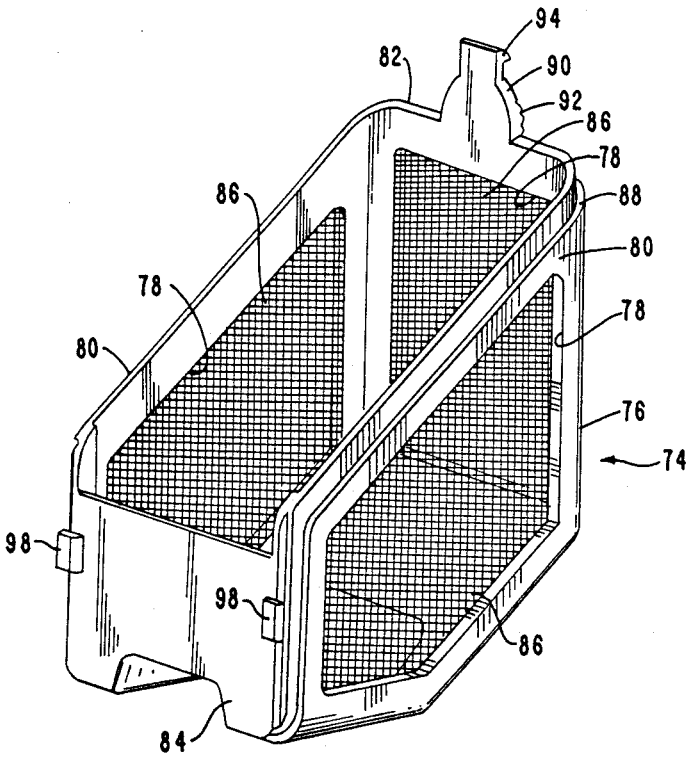
FIG. 2 is a perspective view of an illustrative debris collection container constructed according to this invention.

To collect the debris after it passes outwardly from the exhaust port 72, there is provided in accordance with the principles of this invention a debris collection container 74. The container 74 is formed of a semi-rigid frame member 76 defining a plurality of windows 78. As shown in FIG. 2, the debris collection container 74 has four sides, a bottom and an open top. The windows 78 are preferably located in the lateral walls 80 and the rear wall 82. The front wall 84, as well as the bottom of the container 74, do not have windows. The frame member 76 is preferably molded of polypropylene material and to fill the windows 78 a mesh fabric is placed in the mold form prior to injection of the polypropylene material. Accordingly, the mesh fabric fills the windows 78 and becomes integral with the frame member 76. Preferably, the mesh fabric 86 is formed of woven monofilament nylon. Illustratively, the nylon filament has a diameter of 1.5 mils and the openings of the mesh are spaced at substantially 305 openings per inch, thereby leaving clear openings approximately 45 microns across.

The opening at the top of the container 74 is sized so as to cover the exhaust port 72 in the conduit section 62 of the sander 10. The walls of the container 74 surrounding that opening, as well as the front wall 84, are shouldered at 88 so as to provide a seal with the exhaust port 72 when the container 74 is installed on the sander 10.

FIG. 1 illustrates the container 74 installed on the sander 10. It is apparent from the drawing that the exterior of the container 74 is so configured that it blends in with the contour of the sander 10 to provide an aesthetically pleasing appearance. Thus, the sides of the conduit section 62 are continued by the lateral walls 80 of the container 74; the rear wall of the handle section 22 is continued by the rear wall 82 of the container 74; and the bottom of the container 74 is angled to the same degree as the conduit section 62. Thus, a unitary appearance is effected when the container 74 is installed on the sander 10 without any attendant disadvantages such as are encountered with the use of a filter bag, as previously described.

In order to secure the container 74 on the sander 10, the container 74 is formed with a resilient latch member 90 which extends upwardly from the rear wall 82. The latch member 90 includes a ribbed section 92, which facilitates engagement by the operator's finger, along with an outwardly extending lip 94 at its distal extremity. For cooperating with the latch member 90, the housing is formed with an inwardly extending lip 96 above and adjacent to the exhaust port 72, which lip 96 is complementary with respect to the lip 94 so that engagement therebetween may be effected by the operator moving the latch member 90 upwardly against the lip 96 so that the resilience of the latch member 90 allows the lip 94 to move inwardly to pass over the lip 96, after which it snaps back outwardly to catch on the lip 96, as shown in FIG. 4. The container 74 is further formed with a pair of tab members 98 which extend forward and laterally outward from the front wall 84 of the container 74. These tab members 98 are adapted to engage, from the inside, the rear wall 100 of the housing 12 below the exhaust port 72. To enable the tab members 98 to pass that rear wall 100, t he rear wall 100 of the housing 12 is formed with an open space 102 which is an extension of the exhaust port 72 and a pair of notches 104.

Figure 3:
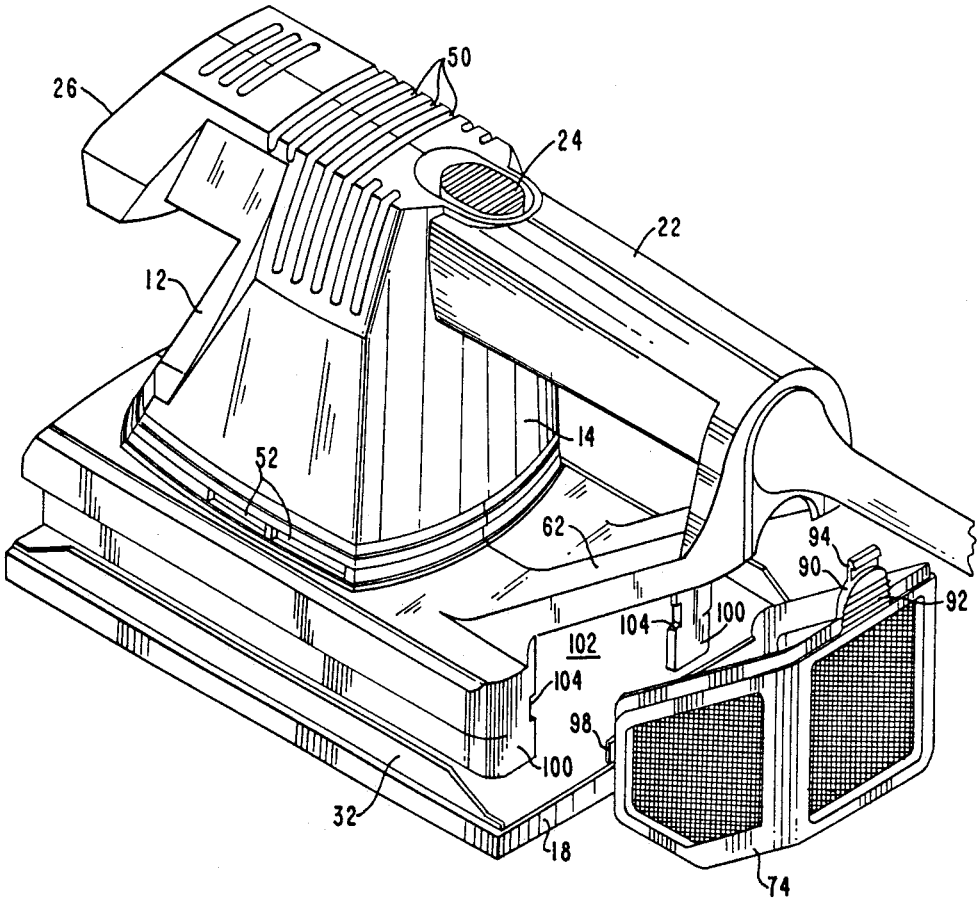
FIG. 3 is a perspective view of the surface treating tool of FIG. 1 with the debris collection container removed and separated from the tool.

FIG. 3 illustrates how the container 74 may be removed from or installed on the sander 10. Thus, for removal, the latch member 90 is pressed inwardly and the container 74 is moved downwardly a sufficient distance that the tab members 98 align with the notches 104. The container 74 is then pulled rearwardly free of the housing 12. For installation, the process is reversed. The container 74 is positioned so that the tab members 98 align with the notches 104 and then the container 74 is moved inwardly and upwardly so that the lip 94 on the latch member 90 engages the lip 96 on the housing 12 and the tab members 98 engage the rear wall 100 of the housing 12.

Thus, when the sander 10 is utilized with the container 74 in place, the debris laden air pulled through the platen holes 54 by the fan 36 travels through the conduit 70, out through the exhaust port 72 and into the container 74. The air then passes through the mesh fabric 86 which traps the debris within the container 74. The amount of debris within the container 74 is readily apparent to the tool operator who may view same through the mesh fabric 86. When this debris reaches a specific level, the operator may readily remove the container 74 and dispose of the debris contained therein by merely inverting the container 74 over a suitable waste receptacle. If desired, the container 74 may be washed or blown with compressed air to completely unclog the openings in the mesh fabric 86. The container 74 is then quickly reinstalled in the tool 10 and surface treatment may be continued.

Accordingly, there has been disclosed an improved debris collection system for a surface treating tool. While an illustrative embodiment of the present invention has been disclosed herein, it will be apparent to those of ordinary skill in the art that various modifications and adaptations to that embodiment are possible and it is only intended that the present invention be limited by the scope of the appended claims.

We claim:

1. A surface treating tool comprising:

a housing:

a rotating electric motor having an output shaft supported within said housing:

a platen carried on said housing and having a surface for supporting an abrasive sheet;

actuating means coupling said motor output shaft to said platen for converting rotary motion of said output shaft to motion of said platen;

a conduit within said housing having an exhaust port through said housing;

suction inducing means mounted on said motor output shaft for removing abrasion produced debris from the surface and directing the debris to said conduit; and a debris collection container mounted on said exhaust port;

the conduit is defined by walls of the housing; and the debris collection container includes:

a semi-rigid frame defining at least one window; and mesh fabric covering said at least one window;

said debris collection container further having an opening which covers said exhaust port when said container is mounted thereon, said container being so configured on its exterior that its blends in with the contour of said tool to provide an aesthetically pleasing appearance.

2. The tool according to claim 1 wherein said mesh fabric is formed of woven monofilament nylon.

3. The tool according to claim 1 wherein said mesh fabric is formed of woven monofilament nylon mesh having generally 45 micron clear openings.

4. The tool according to claim 3 wherein the openings of the mesh are spaced at generally 305 openings per inch.

5. The tool according to claim 1 wherein said housing includes:

a tower section containing said motor;

a generally horizontal handle section extending rearwardly from the upper end of said tower section beyond the rear extremity of said platen; and a conduit section extending from the distal end of said handle section to the lower end of said tower section so as to provide an open handhold region below said handle section, said conduit section containing said conduit therein and being formed with said exhaust port on its lower surface.

6. The tool according to claim 5 wherein said container includes four sides and a bottom, the top of said container being open, at least one of said sides having said at least one window.

7. The tool according to claim 6 wherein said container further includes a pair of tab members extending forward and laterally outward from the front of said container to engage a wall of said housing below said exhaust port and a resilient latch member extending upwardly from the rear of said container to engage a complementarily formed engagement member on said housing above said exhaust port.

8. The tool according to claim 7 wherein walls of said container which mate with the housing exhaust port are formed with shoulders so as to provide a seal with the exhaust port.

* * * * *

UNITED STATES PATENT OFFICE

CERTIFICATE OF CORRECTION

Patent No. 4,967,516 Dated November 6, 1990

Inventor(s) Kiyoshi Hoshino et al

It is certified that error appears in the above-identified patent and that said Letters Patent is hereby corrected as shown below:

Column 5, between lines 32 and 33, insert -- CHARACTERIZED IN THAT -- line 40, change "its", second occurrence, to -- it --

Signed and Sealed this

Third Day of March, 1992

*Attest:*

HARRY F. MANBECK, JR.

*Attesting Officer*

*Commissioner of Patents and Trademarks*